United States Patent [19]

Barbato et al.

[11] Patent Number: 4,571,198

[45] Date of Patent: Feb. 18, 1986

[54] ANIMATED FIGURE HOLDER TOY

[75] Inventors: Michael W. Barbato, Hermosa Beach; Tony Rhodes, Torrance; Edward W. Watts, Long Beach, all of Calif.

[73] Assignee: Mattel, Inc., Hawthorne, Calif.

[21] Appl. No.: 682,021

[22] Filed: Dec. 14, 1984

[51] Int. Cl.[4] ..... A63H 3/00

[52] U.S. Cl. ..... 446/73; 446/313; 446/368

[58] Field of Search ..... 446/73, 72, 71, 74, 446/75, 76, 77, 313, 368, 373, 376, 395, 268

[56] References Cited

U.S. PATENT DOCUMENTS

| | | | |
|---|---|---|---|
| 2,925,686 | 2/1960 | Metrulis | 446/138 |
| 3,392,480 | 7/1968 | Stubbman | 446/121 |
| 3,940,877 | 3/1976 | Culkin | 446/124 |
| 4,044,498 | 8/1977 | Rahmstorf | 446/313 |
| 4,200,197 | 4/1980 | Meyer et al. | 446/73 X |

*Primary Examiner*—Mickey Yu

*Attorney, Agent, or Firm*—Ronald M. Goldman; Melvin A. Klein

[57] ABSTRACT

A holder for animated figures in the form of the simulated skeletal structure of a prehistoric beast, including a simulated rib cage having clip members at the extremeties thereof. Each of the clip members is configured for frictionally retaining an animated figure toy at a portion of its anatomy, particularly the waist. The animated figure holder is provided with a handle for carrying, and includes a skull configured to provide storage space.

15 Claims, 6 Drawing Figures

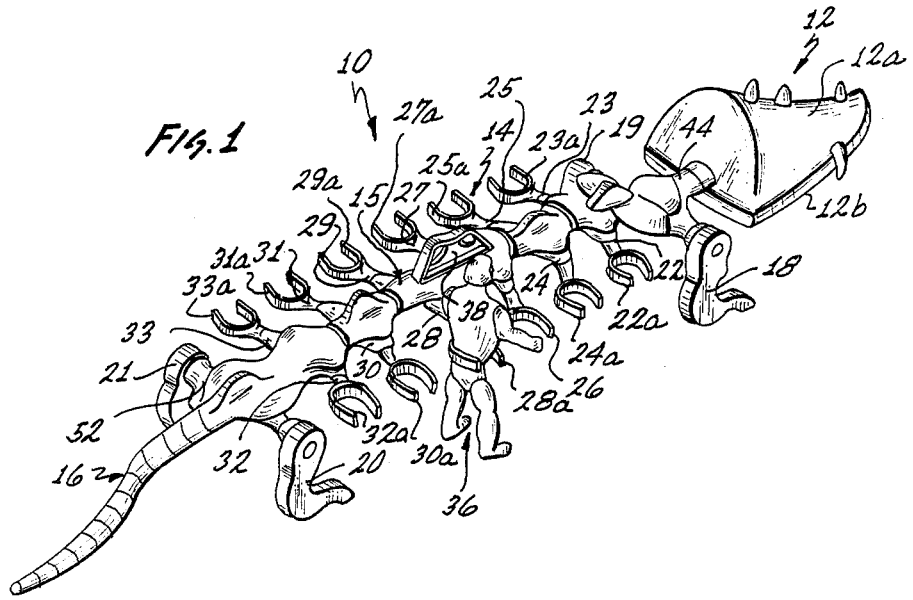
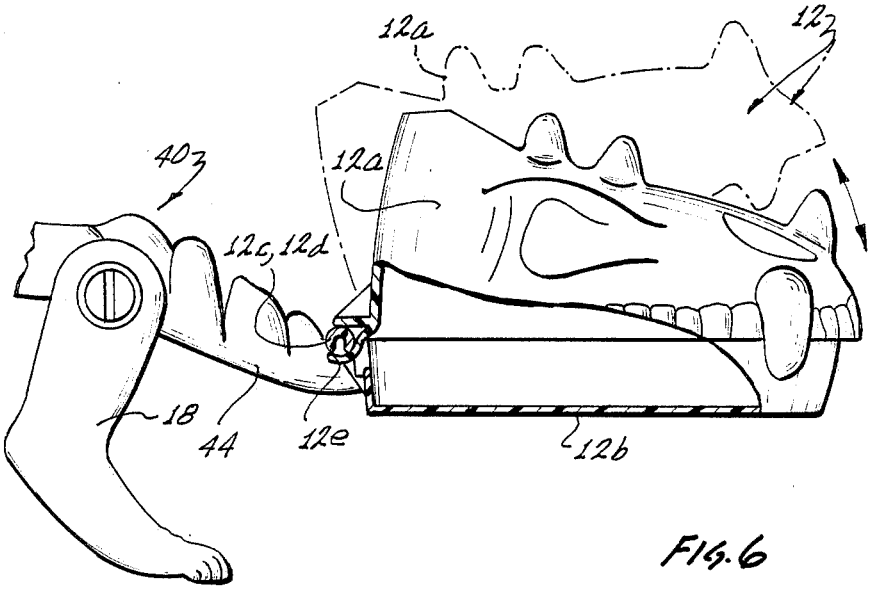
FIG. 6

ANIMATED FIGURE HOLDER TOY

BACKGROUND OF THE INVENTION

The background of the invention will be discussed in two parts:

1. Field of the Invention

The invention relates to toys, and more particularly to a toy for holding and transporting animated figure toys.

2. Description of the Prior Art

Posable action figure toys have become increasingly popular with children, and various accessories have been developed to create a play theme for use with these action figure toys or dolls. Such accessories have included buildings, airplanes, vehicles, helicopters and the like, as well as accessories adapted to be positioned in the hands of the animated figure toys, such as rifles or the like.

Figure toys with interlocking appendages are illustrated in U.S. Pat. No. 3,392,480, entitled "Child's Construction Game", issued to Stubbmann on July 16, 1968. In accordance with the teachings of this patent, the extremities of the appendages of the figure toys are provided with generally U-shaped coupling members, which may be interlocked with one another or with rods, rings or a platform, to form an elaborate arrangement.

A toy which is configured as a horse with storage means in the torso is shown and described in U.S. Pat. No. 2,925,686, entitled "Trojan Horse Toy", issued Feb. 23, 1960, to Metrulis. Toy figures with magnetic bases are concealed within a compartment formed in the body of the toy horse, with a pair of doors formed in the torso providing access. When the door is opened, the toy figures slide down ramps which are provided as part of the toy.

Another toy having means for attachment of other toys is shown and described in U.S. Pat. No. 3,940,877, entitled "Construction Toy Having stuffed Parts of Soft Materials", issued Mar. 2, 1976 to Culkin. This toy simulates a tree having loops on the branches thereof for detachably receiving other simulated objects, such as birds or the like.

It is an object of the present invention to provide a new and improved toy for use with other toys such as animated figures.

It is another object of the present invention to provide a new and improved toy capable of being used as a holder for other toys, such as animated posable figure toys.

It is a further object of the present invention to provide a new and improved animated figure holder in the form of the simulated skeletal structure of a prehistoric beast.

SUMMARY OF THE INVENTION

The foregoing and other objects are accomplished by providing an animated figure holder in the form of the simulated skeletal structure of a prehistoric beast, with the simulated rib cage having clip members at the extremities thereof, each of the clip members being configured for frictionally retaining an animated figure toy or the like at a portion of its anatomy, particularly the waist. The animated figure holder is provided with a handle for carrying. The skull is configured to provide storage space.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the animated figure holder according to the present invention with an animated figure retained thereby;

FIG. 6 is a partial side elevational view, partially broken away and partially in cross-section of the front section of the animated figure holder of FIG. 1, depicting in solid and dotted lines the movement of the skull parts thereof.

DESCRIPTION OF THE PREFERRED EMBODIMENT

Figure 2:
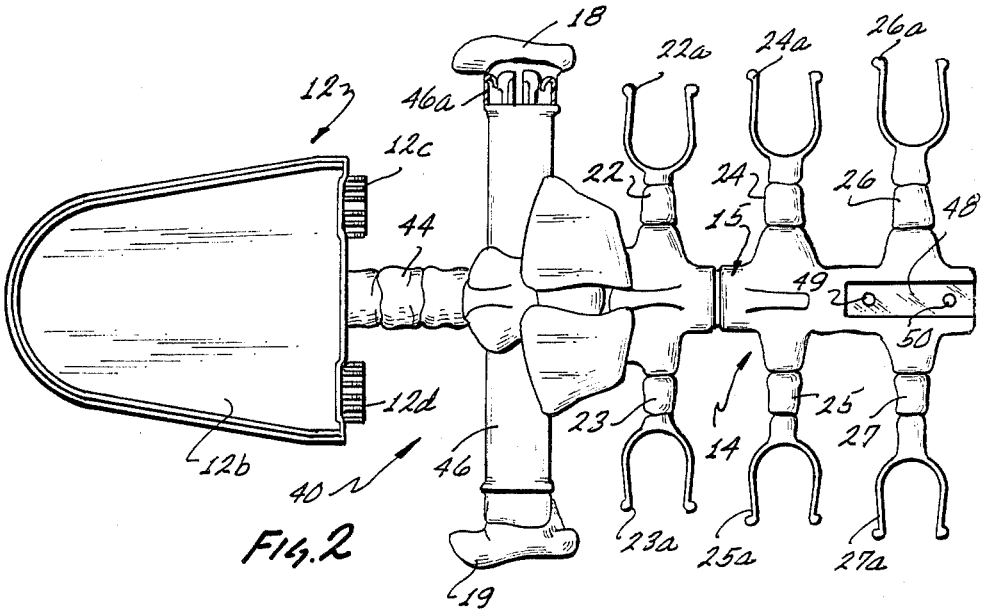
FIG. 2 is a top plan view of the front section of the animated figure holder of FIG. 1.

Referring now to the drawings, and particularly to FIG. 1 there is shown an animated toy figure holder, generally designated 10, configured in the form of the simulated skeletal structure of a prehistoric beast, or reptile, such as a member of the dinosaur family or the like. The holder 10 includes a skull portion, generally designated 12, a spinal portion, generally designated 14, a tail portion, generally designated 16, and four leg portions 18–21, inclusive. The spinal portion 14 includes a spine 15 having a plurality of generally transversely extending simulated ribs 22–33, inclusive, each of which terminates in a clip-shaped end **22*a*–33*a*, respectively. Each rib is configured for frictionally engaging the torso or waist of an animated figure, such as FIG. 36, having the waist thereof engaged by the clip-shaped end 28*a* of rib 28. For ease of carrying, a handle 38 is attached to the spine at the midpoint of the spinal portion 14**.

Figure 3:
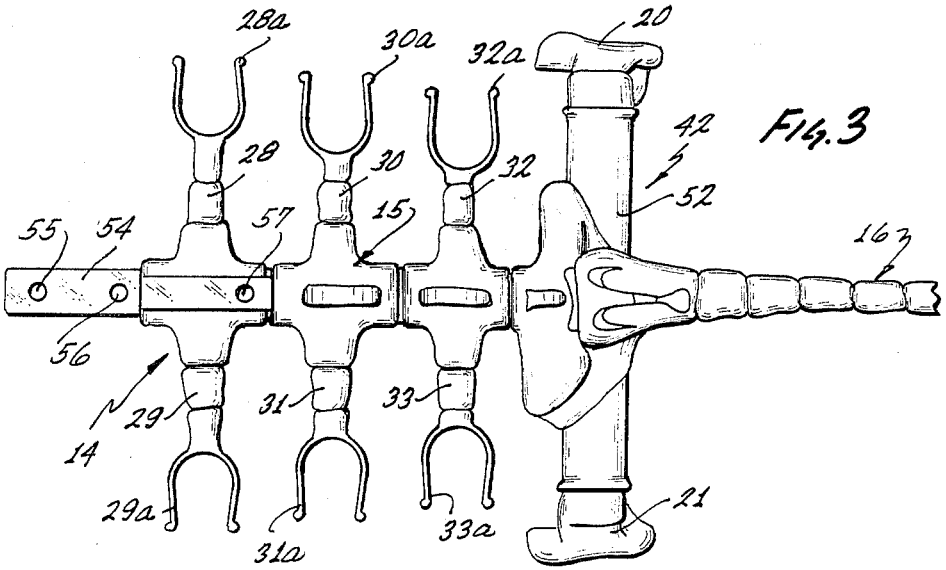
FIG. 3 is a top plan view of the rear section of the animated figure holder of FIG. 1.

By reference to FIGS. 2 through 6, the holder 10 is shown as preferably being formed in sections namely, the front section, generally designated 40, shown in FIG. 2, the rear section, generally designated 42, shown in FIG. 3, the handle 38, and the upper portion of the skull, designated **12*a* (see FIG. 6**).

As shown in FIG. 2, the front section 40 is formed in one piece and includes the simulated lower jaw **12*b* of the skull portion 12, this portion being generally dish-shaped (see also FIG. 6), with the rearward edge including a pair of aligned hinge pins 12*c* and 12*d*. From the rearward edge of the lower jaw 12*b* a neck portion 44 extends generally transverse thereto at the midpoint thereof to form the forward portion of the spine 15 of the spinal portion 14, the spine 15 being formed of simulated vertabrae. A "shoulder bone" 46 extends transversely to the spine 15 at the base of the neck portion 44, with the opposite ends thereof having pivot connections, such as connection 46*a*, for receiving thereon the leg 18** in at least partially pivotable relation.

Rearwardly of the shoulder bone 46, in the front section 40 (FIG. 2), and in generally parallel relation therewith are the simulated ribs, extending from the vertabrae of the spine 15 and being configured in pairs with animated figure retaining means at the ends thereof. The retaining means are in the form of generally U-shaped clip means, 22*a*–27*a*, inclusive, at the ends of each of the ribs 22–27, respectively. The open ends of the clips 22*a*–27*a*, inclusive, face in opposing outward directions, with the ribs arranged in pairs, such as ribs 22 and 23.

At the end of the spinal portion 14, as shown in FIG. 2, the spine 15 includes a depressed generally rectangular planar portion 48 (see also FIGS. 4 and 5) having a pair of spaced aligned apertures 49 and 50 extending therethrough, this planar portion and apertures being configured for interconnection of the parts as will be described.

As shown in FIG. 3, the rear section 42 likewise includes ribs 28–33, inclusive, arranged in oppositely disposed aligned pairs generally transverse to the spine 15 of the spinal portion 14. At the juncture intermediate the spinal portion 14 and the tail 16, the section 42 includes a transversely extending "hip bone" 52, constructed similarly to the shoulder bone 46 with axially aligned pivot members (not shown) for receiving the legs 20 and 21 thereon. Extending in general alignment with the spine 15 of the spinal portion 14, at the front end thereof, there is an integrally formed generally planar rectangular tab projection 54, having a pair of apertures 55 and 56 therein. The apertures 55 and 56 are arranged for alignment with the apertures 49 and 50, respectively of the planar portion 48 of the front section 40 of the holder 10 (see also FIGS. 4 and 5). In addition, just rearwardly of the projection 54 the rear section 42 is provided with a third aperture 57 in alignment with the first pair of apertures. As better illustrated in FIGS. 4 and 5, these three apertures 55–57, inclusive, have tubular depending portions on the undersurface of the rear section 42, for reasons which will become apparent.

Figure 4:
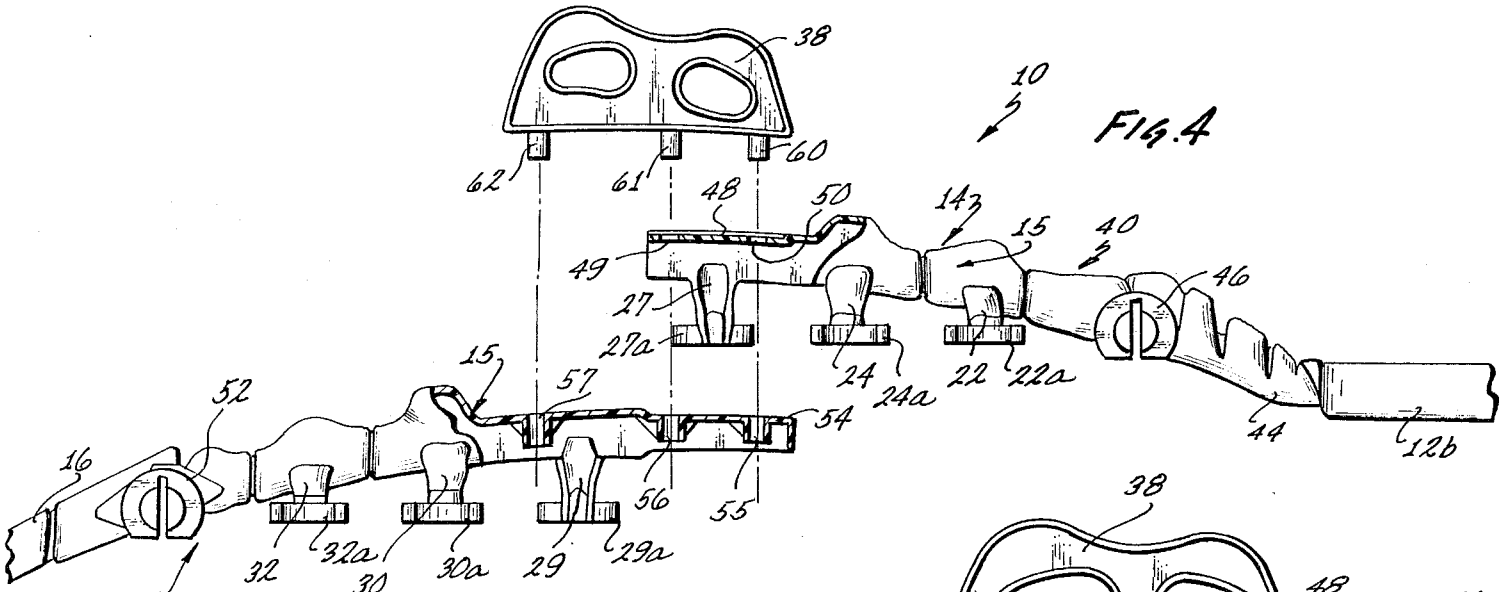
FIG. 4 is an exploded side elevational view of the parts of the animated figure holder of FIG. 1, partially broken away and partially in cross-section.
Figure 5:
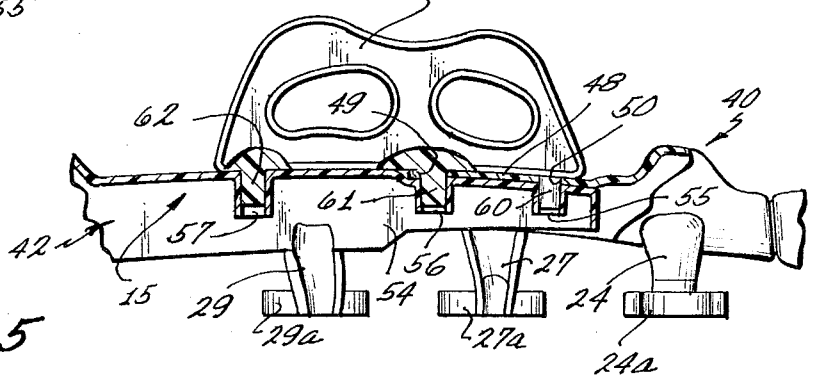
FIG. 5 is an enlarged partial side elevational view, partially in cross-section, illustrating the interconnection of the parts of the animated figure toy shown in FIG. 4.

As best illustrated in FIGS. 4 and 5, the front section 40 and the rear section 42 of the figure holder are secured together by aligning the apertures 49 and 50 in the planar portion 48 of the front section 40 with the apertures 55 and 56, respectively, in the rear section 42. The handle 38 preferably has three depending aligned rod-like projections 60–62, inclusive, with the spacing therebetween adapted for engagement within the provided sets of apertures, with the projection 54 of the rear section 42 beneath the corresponding rectangular planar surface 48 of the front section 40, the rod-like projections 60–62 being dimensioned for frictional engagement with the tubular portions of the apertures 55–57, respectively, for retaining the parts in assembled relation as shown in FIG. 5. As also shown, the handle 38 is provided with finger openings 64 and 66 to facilitate grasping.

By reference to FIG. 6, the skull 12 is shown formed of the lower jaw 12*b* which is the dish-shaped portion of the front section 40, and an upper pivotably secured upper jaw and head portion 12*a*, which is provided at the rearward edge thereof with hinge clips 12*e* (only one of which is shown in FIG. 5) for engaging the corresponding hinge pins 12*c* and 12*d*. As shown, the upper jaw and skull portion 12*a* is formed as a shell with a lower edge lying in a plane, to coact with the upper edge of the dish-shaped lower jaw 12*b* to form a compartment therein. The upper jaw and head portion 12*a* are pivotable for opening and closing as shown in dotted lines.

In accordance with the present invention, a child not only has a carrier and transporting unit for animated posable dolls or figures, but storage capacity for accessory items, while having an additional item in the form of a "dinosaur" for enhancing the play value.

While there has been shown and described a preferred embodiment, it is to be understood that various other adaptations and modifications may be made within the spirit and scope of the invention.

We claim:

1. In a device for enabling the holding and transporting of figure toys, the combination comprising a structure simulating the skeleton of a beast, said structure including simulated rib members connected to an elongated spinal portion, at least some of said rib members having integrally formed therewith means for releasably retaining a figure toy thereby.

2. In a device for enabling the holding and transporting of figure toys, the combination comprising a structure simulating the skeleton of a beast, said structure including simulated rib members, at least some of said rib members having integrally formed therewith means for releasably retaining a figure toy thereby, wherein said means for releasably retaining a figure toy includes clip means.

3. The combination according to claim 2 wherein said structure includes a spinal portion and handle means coacting with said spinal portion for enabling the carrying of said device.

4. The combination according to claim 2 wherein said clip means are generally U-shaped.

5. The combination according to claim 3 wherein said structure further includes a simulated skull portion configured for providing storage space therein.

6. The combination according to claim 5 wherein said skull portion includes a lower jaw portion and an upper jaw portion, at least one of said jaw portions being pivotable relative to the other for enabling access to the storage space therein.

7. The combination according to claim 6 wherein said structure further includes a plurality of leg members coupled thereto.

8. In a toy, the combination comprising: at least one figure toy; a figure toy holder, said holder including:

(a) a spinal portion simulating the spine of a beast;
(b) a skull portion attached to said spinal portion, said skull portion simulating the skull of a beast;
(c) rib means attached to and extending generally transversely to said spinal portion;
(d) means on at least some of said rib means for releasably holding said at least one figure toy; and
(e) handle means on said spinal portion for enabling the carrying of said holder.

9. The combination according to claim 8 wherein said at least one figure toy includes a waist portion, and said means on said rib means are configured for engaging said waist portion.

10. The combination according to claim 9 wherein said means on said rib means are clip means formed integrally therewith.

11. The combination according to claim 10 wherein said clip means are generally U-shaped clip portions formed integrally with said at least some of said rib means.

12. The combination according to claim 11 wherein said skull portion is configured for providing storage space therein.

13. The combination according to claim 12 wherein said skull portion is formed in two parts, at least one of said parts being pivotable relative to the other.

14. The combination according to claim 13 wherein said holder further includes a simulated skeletal tail structure and appendages.

15. The combination according to claim 14 wherein said holder is configured to simulate the skeletal structure of a member of the dinosaur family.

* * * * *